US006161947A

United States Patent [19]

Schinsky et al.

[11] Patent Number: 6,161,947

[45] Date of Patent: Dec. 19, 2000

[54] LIGHT FIXTURE ASSEMBLY AND ADAPTER RING THEREFOR HAVING EXTERIOR FASTENING ARRANGEMENTS

[75] Inventors: Michael J. Schinsky, Webster Groves, Mo.; Darrell F. Conrad, Alhambra; James J. Wojcicki, Webster Groves, both of Ill.

[73] Assignee: Hubbell Incorporated, Orange, Conn.

[21] Appl. No.: 09/201,381

[22] Filed: Nov. 30, 1998

[51] Int. Cl.[7] ..... F21V 21/00

[52] U.S. Cl. ..... 362/374; 362/374; 362/375; 362/376; 362/365

[58] Field of Search ..... 362/374, 375, 362/376, 365, 368, 370, 265, 260, 457

[56] References Cited

U.S. PATENT DOCUMENTS 5,477,442 12/1995 Self ..... 362/368

OTHER PUBLICATIONS

Advertising publications by Killard Electric MFG. Company, entitled "NLW 800–Watt Mercury Vapor Fixture" (2 pages) and "Self–Ballasted (HID) 400 Watt Mercury Vapor Fixture" (2 pages).

Killard Catalog Sheet 0371371, Section 12A, p. 15, entitled Mercury Vapor Enclosed & Gasketed Lighting Fixtures.

*Primary Examiner*—Thomas M. Sember
*Assistant Examiner*—Bertrand Zeade
*Attorney, Agent, or Firm*—Michael R. Swartz; Jerry M. Presson

[57] ABSTRACT

A light fixture assembly includes a mounting plate, a ballast housing, and an adapter ring for attaching the ballast housing to the mounting plate. The adapter ring includes an annular body having opposite upper and lower annular portions and opposite exterior and interior sides. The upper annular portion has a continuous upper annular surface located between the opposite exterior and interior sides and adapted for sealably engaging the mounting plate. The lower annular portion has a continuous lower annular surface located between the opposite exterior and interior sides and adapted for sealably engaging the ballast housing. Upper and lower exterior fastening arrangements are provided on the adapter ring for removably securing the ballast housing to the mounting plate. The upper fastening arrangement is disposed on the upper annular portion of the annular body at the exterior side thereof and spaced outwardly from the continuous upper annular surface of the annular body. The lower fastening arrangement is disposed on the lower annular portion of the annular body at the exterior side thereof and spaced outwardly from the continuous lower annular surface of the annular body.

20 Claims, 1 Drawing Sheet

LIGHT FIXTURE ASSEMBLY AND ADAPTER RING THEREFOR HAVING EXTERIOR FASTENING ARRANGEMENTS

BACKGROUND OF THE INVENTION

1. Field of the Invention

The present invention generally relates to light fixtures and, more particularly, is concerned with a light fixture assembly and an adapter ring therefor having exterior fastening arrangements.

2. Description of the Prior Art

Light fixtures may be used in a variety of different environments. Some environments may expose a fixture to water, extreme temperatures, flammable materials or other hazardous elements. Certain fixtures are specially made for use in such environments. The fixture typically includes a ballast housing and a mounting plate to secure the fixture to a support structure, such as a pole or building surface. An adapter ring is generally needed to attach incompatible ballast housings and mounting plates to one another, such as a later-designed ballast housing to an earlier-designed mounting plate or the ballast housing of one supplier to the mounting plate of another supplier.

A representative example of a light fixture having an adapter ring is disclosed in U.S. Pat. No. 5,477,442 to Self. The Self adapter ring has a fastening arrangement for removably securing the adapter ring to the mounting plate. The fastening arrangement includes a hinge bar on the adapter ring which is engageable with a hinge hook on the mounting plate, a threaded hole through a boss on the adapter ring diametrically opposite the hinge bar which aligns with a hole through an external bracket on the mounting plate, and a fastening screw that inserts through the hole in the mounting plate bracket and threads into the threaded hole in the adapter ring boss for attaching the adapter ring to the mounting plate. Since the threaded hole through the adapter ring boss passes from exterior to interior sides thereof, a pair of sealing washers are provided along the screw about opposite ends of the adapter ring hole in order to seal the interior of the fixture from the exterior environment at the location of the adapter ring hole.

A similar adapter ring was previously developed and sold in 1970 by Killark Electric Mfg. Company, now a division of Hubbell, Inc., the assignee of the present invention. A problem exists, however, with these prior art adapter ring designs. The mounting screw passes through the wall of the adapter ring from the exterior to interior sides thereof and thus must be sealed to prevent dust or liquid from entering the fixture.

Consequently, a need remains for an adapter ring which provides a solution to the aforementioned problem in the prior art without introducing any new problems in place thereof.

SUMMARY OF THE INVENTION

The present invention provides a light fixture assembly and an adapter ring therefor designed to satisfy the aforementioned need. The light fixture assembly and adapter ring of the present invention employ exterior fastening arrangements which include a mounting screw and an upper exterior tab having an aperture receiving the mounting screw, with the opposite ends of the aperture disposed at the exterior side of the adapter ring. Thus, instead of passing through a hole in the adapter ring from the exterior to interior side thereof as in the prior art, the mounting screw of the adapter ring of the present invention passes through the aperture in the upper exterior tab adjacent to the exterior side of the adapter ring and never penetrates to the interior side thereof. There is no hole present in the adapter ring of the present invention that would permit passage of dust or liquid into the fixture. Consequently, sealing around the mounting screw is not necessary in the adapter ring of the present invention.

Accordingly, the present invention is directed to an adapter ring for attaching a ballast housing to a mounting plate of a light fixture assembly. The adapter ring comprises: (a) an annular body having opposite upper and lower annular portions and opposite exterior and interior sides, the upper annular portion having a continuous upper annular surface located between the opposite exterior and interior sides and adapted for fitting with a mounting plate of a light fixture, the lower annular portion having a continuous lower annular surface located between the opposite exterior and interior sides and adapted for fitting with a ballast housing of the light fixture; (b) upper fastening means for removably securing the adapter ring to the mounting plate, the upper fastening means being disposed on the upper annular portion of the annular body at the exterior side thereof and spaced outwardly from the continuous upper annular surface of the annular body; and (c) lower fastening means for removably securing the adapter ring to the ballast housing, the lower fastening means being disposed on the lower annular portion of the annular body at the exterior side thereof and spaced outwardly from the continuous lower annular surface of the annular body.

More particularly, the upperfastening means includes an upper exterior tab attached to and extending outwardly from the upper annular portion of the annular body. The upper exterior tab has an aperture defined therethrough with opposite ends disposed adjacent to and outwardly from the exterior side of the annular body. The upper fastening means further includes a fastener insertable through and removable from the aperture of the upper exterior tab for facilitating securement of the adapter ring to the mounting plate. The fastener is an externally threaded mounting screw threadable into and from an internally threaded hole defined in an external side bracket on the mounting plate.

The present invention is also directed to a light fixture assembly which comprises: (a) a mounting plate; (b) a ballast housing; and (c) the adapter ring as described above. The upper fastening means of the adapter ring is engageable with bottom fastening elements of the mounting ring for removably securing the adapter ring to the mounting plate. The lower fastening means of the adapter ring is engageable with top fastening elements of the ballast housing for removably securing the adapter ring to the ballast housing.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
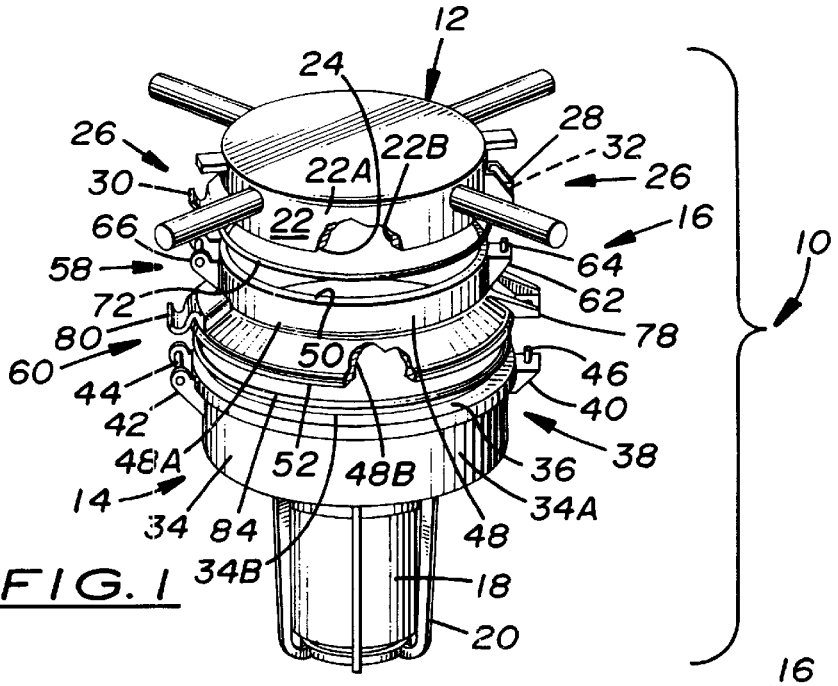
FIG. 1 is an exploded view of a light fixture assembly of the present invention including a mounting plate, a ballast housing and an adapter ring of the present invention disposed between the mounting plate and ballast housing.
Figure 2:
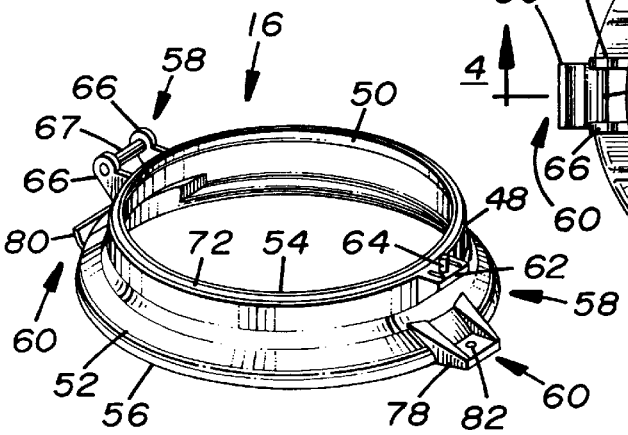
FIG. 2 is a perspective view of the adapter ring of the present invention by itself.
Figure 3:
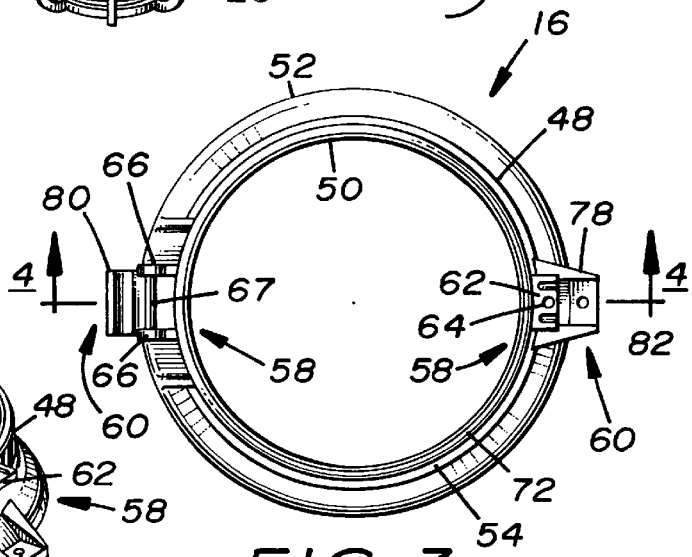
FIG. 3 is a top plan view of the adapter ring.
Figure 4:
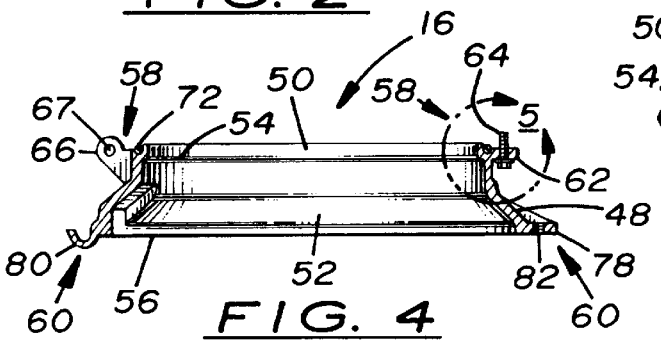
FIG. 4 is a cross-sectional view of the adapter ring taken along line 4—4 of FIG. 3.
Figure 5:
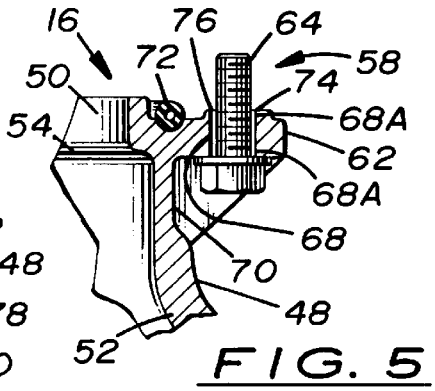
FIG. 5 is an enlarged detailed view of an area of the adapter ring enclosed by circle 5 of FIG. 4.

Referring to the drawings and particularly to FIG. 1, there is illustrated a light fixture assembly of the present invention, generally designated 10, designed for use in hazardous environments. The assembly 10 basically includes a mounting plate 12, a ballast housing 14, and an adapter ring 16 also of the present invention. The mounting plate 12 and ballast housing 14 of the assembly 10 have respective constructions which are the same as found in aforementioned prior art light fixtures also designed for use in hazardous environments. The mounting plate 12 and the ballast housing 14 may not be compatible for direct attachment to one another. The adapter ring 16 of the assembly 10, which is improved in accordance with the present invention over the prior art adapter rings, attaches to each of the mounting plate 12 and ballast housing 14 and thereby enables the incompatible mounting plate 12 and ballast housing 14 to be removably secured to one another. Either one of the mounting plate 12 and ballast housing 14 by being separate components can be replaced without requiring replacement of the other. Also, the light fixture assembly 10 includes a light globe 18 and guard 20 which may be attached to the ballast housing 14 in a known manner to protect a lamp (not shown) enclosed by the globe 18.

The mounting plate 12 of the assembly 10 includes a continuous annular side wall 22 with opposite external and internal sides 22A, 22B and a continuous bottom annular surface 24 located between the opposite external and internal sides 22A, 22B. The mounting plate 12 also includes bottom fastening elements 26 disposed on the continuous annular side wall 22 at the external side 22A thereof and spaced outwardly from the continuous bottom annular surface 24. The bottom fastening elements 26 of the mounting plate 12 include an external side bracket 28 and an external side hinge hook 30. The external side bracket 28 and external side hinge hook 30 are attached to and extend radially outwardly from locations at diametrically opposite sides of the continuous annular side wall 22 of the mounting plate 12. The external side bracket 28 has an internallythreaded hole 32 defined therethrough.

The ballast housing 14 of the assembly 10 includes a continuous annular side wall 34 having opposite external and internal sides 34A, 34B and a continuous top annular surface 36 located between the opposite external and internal sides 34A, 34B. The ballast housing 14 also includes top fastening elements 38 disposed on the continuous annular side wall 34 and spaced outwardly from the continuous top annular surface 36. The top fastening elements 38 of the ballast housing 14 include an external side bracket 40 and a pair of external side hinge tabs 42 supporting a hinge pin 44 therebetween. The external side bracket 40 and external side hinge tabs 42 are attached to and extend outwardly from locations at diametrically opposite sides of the continuous annular side wall 34 of the ballast housing 14. The external side bracket 40 has a hole defined therethrough receiving a fastener 46.

Referring now to FIGS. 1 to 5, the adapter ring 16 of the assembly 10 includes an annular body 48 having opposite upper and lower annular portions 50, 52 and opposite exterior and interior sides 48A, 48B. The upper annular portion 50 of the annular body 48 has a continuous upper annular surface 54 which is located between the opposite exterior and interior sides 48A, 48B and adapted for fitting with the continuous bottom annular surface 24 on the annular side wall 22 of the mounting plate 12. The lower annular portion 52 of the annular body 48 has a continuous lower annular surface 56 which is located between the opposite exterior and interior sides 48A, 48B and adapted for fitting with the continuous top annular surface 36 on the side wall 34 of the ballast housing 14.

The adapter ring 16 further includes upper fastening means 58 and lower fastening means 60 respectively associated with the upper and lower annular portions 50, 52 of the annular body 48 of the adapter ring 16. The upper fastening means 58 are engageable with the bottom fastening elements 26 of the mounting plate 12 for removably securing the adapter ring 16 to the mounting plate 12. The lower fastening means 60 are engageable with the top fastening elements 38 of the ballast housing 14 for removably securing the adapter ring 16 to the ballast housing 14.

More particularly, the upper fastening means 58 are disposed on the upper annular portion 50 of the annular body 48 at the exterior side 48A thereof and spaced outwardly from the continuous upper annular surface 54 on the annular body 48. The upper fastening means 58 includes an upper exterior tab 62, a fastener 64 and a pair of exterior upper hinge tabs 66 supporting an upper hinge pin 67 therebetween. The upper external tab 62 and exterior upper hinge tabs 66 are attached to and extend outwardly from locations at diametrically opposite sides of the upper annular portion 50 of the annular body 48 of the adapter ring 16. The upper external tab 62 has an aperture 68 defined therethrough. The fastener 64 is in the form of an externally threaded mounting screw 64 insertable through and removable from the aperture 68 in the upper exterior tab 62 and threadable into and from the internally threaded hole 32 in the external side bracket 28 on the mounting plate 12. With opposite ends 68A of the aperture 68 disposed adjacent to and outwardly from the exterior side 48A of the annular body 48, the insertion of the fastener 64 through the aperture 68 does not involve penetration of the annular body 48 of the adapter ring 16. Adjacent to and below the upper exterior tab 62 is located a recess 70 defined in the upper annular portion 50 of the annular body 48. The recess 70 provide clearance for a tool (not shown) to engage the mounting screw 64 for turning the screw 64 threadably into and from the internally threaded hole 32 in the external side bracket 28 on the mounting plate 12. The upper hinge pin 67 can be aligned and engaged with the external side hinge hook 30 of the mounting plate 12 concurrently as the fastener 64 is aligned with and threaded into the hole 32 of the side bracket 28 of the mounting plate 12 so as to tightly secure the adapter ring 16 to the mounting plate 12.

The upper fastening means 58 further includes an annular gasket 72 and a buffer pad 74 being exemplified as a pair of parallel ribs cast into the top surface of tab 62 and disposed adjacent opposite sides of the aperture 68 in the tab 62. The annular gasket 72 is disposed on and extending about the upper annular surface 54 of the annular body 48 of the adapter ring 16 and is compressed between the upper annular surface 54 of the adapter ring 16 and bottom annular surface 24 of the mounting plate 12 when the adapter ring 16 is secured to the mounting plate 12 as described above. The annular gasket 72 preferably is in the form of hollow tubing and comprised substantially of a resilient compressible silicone material. The buffer pad 74 is disposed against the external side bracket 28 of the mounting plate 12 when the fastener 64 is threaded into the hole 32 in the side bracket 28. The pad 74 provides a buffer between the upper exterior tab 62 of the adapter ring 16 and the external side bracket 28 of the mounting plate 12 so as to allow the fastener or mounting screw 64 to be tightened with the external side bracket 28. The pad 74 provides an opening 76 aligned with the aperture 68 in the upper exterior tab 62 of the adapter ring 16 and the hole 32 in the external side bracket 28 of the mounting plate 12. While allowing the mounting screw 64 to be fully tightened, the pad 74 also allows the annular gasket 72 to be evenly compressed between the continuous annular surfaces 24, 36 of the mounting plate 12 and adapter ring 16.

The lower fastening means 60 are disposed on the lower annular portion 52 of the annular body 48 at the exterior side 48A thereof and spaced outwardly from the continuous lower annular surface 56 on the annular body 48. The lower fastening means 60 includes a lower exterior bracket 78 and a lower hinge hook 80. The lower exterior bracket 78 and lower hinge hook 80 are attached to and extend outwardly from locations at diametrically opposite sides of the lower annular portion 52 of the annular body 48 of the adapter ring 16. The lower exterior bracket 78 has an internally threaded hole 82 defined therethrough for threadably receiving the fastener 46 mounted to the side bracket 40 of the ballast housing 14. With opposite ends 82A of the hole 82 disposed adjacent to and outwardly from the exterior side 48A of the annular body 48, the insertion of the fastener 46 through the hole 82 does not involve penetration of the annular body 48 of the adapter ring 16. The lower hinge hook 80 of the adapter ring 16 can be aligned and engaged with the external side hinge pin 44 of the ballast housing 14 concurrently as the fastener 46 of the ballast housing 14 is aligned with and threaded into the hole 82 of the lower exterior bracket 78 of the mounting plate 12 so as to tightly secure the adapter ring 16 to the ballast housing 14.

The lower fastening means 60 further includes another annular gasket 84 disposed on and extending about the top annular surface 36 of the ballast housing 14 which is compressed between the lower annular surface 56 of the adapter ring 16 and top annular surface 36 of the ballast housing 14 when the adapter ring 16 is secured to the ballast housing 14 as described above. The annular gasket 84 preferably is in the form of hollow tubing and comprised substantially of a resilient compressible silicone material.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

What is claimed is:

1. An adapter ring for attaching a ballast housing to a mounting plate of a light fixture assembly, said adapter ring comprising:

(a) an annular body having opposite upper and lower annular portions and opposite exterior and interior sides, said upper annular portion having a continuous upper annular surface located between said opposite exterior and interior sides and adapted for fitting with a mounting plate of a light fixture assembly, said lower annular portion having a continuous lower annular surface located between said opposite exterior and interior sides and adapted for fitting with a ballast housing of the light fixture assembly;

(b) upper fastening means for removably securing said adapter ring to the mounting plate without penetrating said annular body between said exterior and interior sides thereof, said upper fastening means being disposed on said upper annular portion of said annular body at said exterior side thereof and outwardly from said continuous upper annular surface of said annular body; and (c) lower fastening means for removably securing said adapter ring to the ballast housing without penetrating said annular body between said exterior and interior sides thereof, said lower fastening means being disposed on said lower annular portion of said annular body at said exterior side thereof and outwardly from said continuous lower annular surface of said annular body.

2. An adapter ring for attaching a ballast housing to a mounting plate of a light fixture assembly, said adapter ring comprising:

(a) an annular body having opposite upper and lower annular portions and opposite exterior and interior sides, said upper annular portion having a continuous upper annular surface located between said opposite exterior and interior sides and adapted for fitting with a mounting plate of a light fixture assembly, said lower annular portion having a continuous lower annular surface located between said opposite exterior and interior sides and adapted for fitting with a ballast housing of the light fixture assembly;

(b) upper fastening means for removably securing said adapter ring to the mounting plate without penetrating said annular body between said exterior and interior sides thereof, said upper fastening means being disposed on said upper annular portion of said annular body at said exterior side thereof and outwardly from said continuous upper annular surface of said annular body, said upper fastening means including an upper exterior tab attached to and extending outwardly from said upper annular portion of said annular body, said upper exterior tab having an aperture defined therethrough with opposite ends disposed adjacent to and outwardly from said exterior side of said annular body; and (c) lower fastening means for removably securing said adapter ring to the ballast housing without penetrating said annular body between said exterior and interior sides thereof, said lower fastening means being disposed on said lower annular portion of said annular body at said exterior side thereof and outwardly from said continuous lower annular surface of said annular body.

3. The adapter ring as recited in claim 2, wherein said upper fastening means further includes a fastener insertable through and removable from said aperture of said upper exterior tab.

4. The adapter ring as recited in claim 3, wherein said fastener of said upper fastening means is an externally threaded mounting screw threadable into and from an internally threaded hole defined in an external side bracket on the mounting plate.

5. The adapter ring as recited in claim 4, wherein said upper annular portion of said annular body adjacent to and below said upper exterior tab has a recess providing clearance for a tool to engage said mounting screw for turning said screw threadably into and from the internally threaded hole in the external side bracket of the mounting plate.

6. The adapter ring as recited in claim 5, wherein said upper fastening means further include a pad mounted to said upper exterior tab and disposable against the external side bracket of the mounting plate for providing a buffer between said upper exterior tab and the external side bracket of the mounting plate allowing said externally threaded mounting screw to be tightened with the external side bracket of the mounting plate, said pad defining an opening therethrough aligned with said aperture of said upper exterior tab and with the hole of the external side bracket of the mounting plate.

7. The adapter ring as recited in claim 2, wherein said upper fastening means further includes an upper hinge element attached to and extending outwardly from said upper annular portion of said annular body, said upper hinge element being engageable with an external side hinge element on the mounting plate.

8. The adapter ring as recited in claim 7, wherein said upper hinge element is circumferentially spaced about said annular body at a location diametrically across from said upper exterior tab.

9. The adapter ring as recited in claim 1, wherein said lower fastening means includes a lower exterior bracket attached to and extending outwardly from said lower annular portion of said annular body, said lower exterior bracket having a hole for receiving a fastener on the ballast housing.

10. The adapter ring as recited in claim 9, wherein said lower fastening means further includes a lower hinge element attached to and extending outwardly from said lower annular portion of said annular body, said lower hinge element being engageable with an external side hinge element on the ballast housing.

11. A light fixture assembly, comprising:

(a) a mounting plate including (i) a continuous annular side wall having opposite external and internal sides and a continuous bottom annular surface located between said opposite external and internal sides, and (ii) bottom fastening elements disposed on said continuous annular sidewall of said mounting plate at said external side thereof and spaced outwardly from said continuous bottom annular surface;

(b) a ballast housing for supporting a globe, said ballast housing including (i) a continuous annular side wall having opposite external and internal sides and a continuous top annular surface located between said opposite external and internal sides, and (ii) top fastening elements disposed on said continuous annular side wall of said ballast housing at said external side thereof and spaced outwardly from said continuous top annular surface; and (c) an adapter ring including (i) an annular body having opposite upper and lower annular portions and opposite exterior and interior sides, said upper annular portion having a continuous upper annular surface located between said opposite exterior and interior sides and adapted for fitting with said continuous bottom annular surface of said mounting plate, said lower annular portion having a continuous lower annular surface located between said opposite exterior and interior sides and adapted for fitting with said continuous top annular surface of said ballast housing, (ii) upperfastening means engageable said bottom fastening elements of said mounting plate for removably securing said adapter ring to said mounting plate without penetrating said annular body between said exterior and interior sides thereof, said upper fastening means being disposed on said upper annular portion of said annular body at said exterior side thereof and outwardly from said continuous upper annular surface of said annular body, and (iii) lower fastening means engageable with said top fastening elements of said ballast housing for removably securing said adapter ring to the ballast housing without penetrating said annular body between said exterior and interior sides thereof, said lower fastening means being disposed on said lower annular portion of said annular body at said exterior side thereof and outwardly from said continuous lower annular surface of said annular body.

12. A light fixture assembly, comprising:

(a) a mounting plate including (i) a continuous annular side wall having opposite external and internal sides and a continuous bottom annular surface located between said opposite external and internal sides, and (ii) bottom fastening elements disposed on said continuous annular side wall of said mounting plate at said external side thereof and spaced outwardly from said continuous bottom annular surface;

(b) a ballast housing for supporting a globe, said ballast housing including (i) a continuous annular side wall having opposite external and internal sides and a continuous top annular surface located between said opposite external and internal sides, and (ii) top fastening elements disposed on said continuous annular side wall of said ballast housing at said external side thereof and spaced outwardly from said continuous top annular surface; and (c) an adapter ring including (i) an annular body having opposite upper and lower annular portions and opposite exterior and interior sides, said upper annular portion having a continuous upper annular surface located between said opposite exterior and interior sides and adapted for fitting with said continuous bottom annular surface of said mounting plate, said lower annular portion having a continuous lower annular surface located between said opposite exterior and interior sides and adapted for fitting with said continuous top annular surface of said ballast housing, (ii) upperfastening means engageable said bottom fastening elements of said mounting plate for removably securing said adapter ring to said mounting plate without penetrating said annular body between said exterior and interior sides thereof, said upper fastening means being disposed on said upper annular portion of said annular body at said exterior side thereof and outwardly from said continuous upper annular surface of said annular body, said upper fastening means including an upper exterior tab attached to and extending outwardly from said upper annular portion of said annular body of said adapter ring, said upper exterior tab having an aperture defined therethrough with opposite ends disposed adjacent to and outwardly from said exterior side of said annular body, and (iii) lower fastening means engageable with said top fastening elements of said ballast housing for removably securing said adapter ring to the ballast housing without penetrating said annular body between said exterior and interior sides thereof, said lower fastening means being disposed on said lower annular portion of said annular body at said exterior side thereof and outwardly from said continuous lower annular surface of said annular body.

13. The assembly as recited in claim 12, wherein said upper fastening means of said adapter ring further includes a fastener insertable through and removable from said aperture of said upper exterior tab.

14. The assembly as recited in claim 13, wherein:

said bottom fastening elements of said mounting plate include an external side bracket attached to and extending outwardly from said continuous annular side wall of said mounting plate and having an internally threaded hole defined therethrough; and said fastener of said upper fastening means of said adapter ring is an externally threaded mounting screw threadable into and from said internally threaded hole in said external side bracket on said mounting plate.

15. The assembly as recited in claim 14, wherein said upper annular portion of said annular body adjacent to and below said upper exterior tab has a recess providing clearance for a tool to engage said mounting screw for turning said screw threadably into and from said internally threaded hole in said external side bracket of said mounting plate.

16. The assembly as recited in claim 15, wherein said upper fastening means of said adapter ring further include a pad mounted to said upper exterior tab and disposable against said external side bracket of said mounting plate for providing a buffer between said upper exterior tab of said adapter ring and said external side bracket of said mounting plate allowing said externally threaded mounting screw to be tightened with said external side bracket of said mounting plate, said pad defining an opening therethrough aligned with said aperture of said upper exterior tab and with said hole of said external side bracket of said mounting plate.

17. The assembly as recited in claim 12, wherein:

said upper fastening means of said adapter ring further includes a upper hinge element attached to and extending outwardly from said upper annular portion of said annular body of said adapter ring; and said bottom fastening elements of said mounting plate include an external side hinge element attached to and extending outwardly from said continuous annular side wall of said mounting plate and being engageable with said upper hinge element on said annular body of said adapter ring.

18. The assembly as recited in claim 17, wherein said upper hinge element is circumferentially spaced about said annular body of said adapter ring at a location diametrically across from said upper exterior tab.

19. The assembly as recited in claim 11, wherein:

said top fastening elements of said ballast housing include an external side bracket attached on and extending outwardly from said continuous annular side wall thereof and having a fastener mounted to said external side bracket; and said lower fastening means of said adapter ring includes a lower exterior bracket attached to and extending outwardly from said lower annular portion of said annular body of said adapter ring, said lower exterior bracket having a hole for receiving said fastener on said external side bracket of said ballast housing.

20. The assembly as recited in claim 19, wherein:

said lower fastening means of said adapter ring further includes a lower hinge element attached to and extending outwardly from said lower annular portion of said annular body of said adapter ring; and said top fastening elements of said ballast housing include an external side hinge element attached to and extending outwardly from said continuous annular side wall of said ballast housing and being engageable with said lower hinge element on said annular body of said adapter ring.

* * * * *